US005271126A

United States Patent [19]

Clement et al.

[11] Patent Number: 5,271,126

[45] Date of Patent: Dec. 21, 1993

[54] DETACHING ROLLER AGGREGATE FOR A COMBING MACHINE

[75] Inventors: Heinz Clement, Winterthur; Jean-Claude Allemann, Ruterschen; Kurt Ritz, Sennhof, all of Switzerland

[73] Assignee: Rieter Machine Works, Ltd., Winterthur, Switzerland

[21] Appl. No.: 940,082

[22] Filed: Sep. 3, 1992

[30] Foreign Application Priority Data

Sep. 5, 1991 [CH] Switzerland ..... 02610/91

[51] Int. Cl.[5] ..... D01G 19/04

[52] U.S. Cl. ..... 19/231

[58] Field of Search ..... 19/231, 225, 229, 232, 19/115 A, 219, 266, 273, 274, 277, 282

[56] References Cited

U.S. PATENT DOCUMENTS

| | | | |
|---|---|---|---|
| 1,495,743 | 5/1924 | Horridge | 19/231 |
| 1,534,784 | 4/1925 | Horridge | 19/232 |
| 2,489,015 | 11/1949 | Denham | 19/135 |

FOREIGN PATENT DOCUMENTS

| | | | |
|---|---|---|---|
| 317793 | 9/1902 | France . | |
| 291242 | 5/1928 | United Kingdom . | |
| 1135241 | 12/1968 | United Kingdom | 19/231 |

*Primary Examiner*—Peter Nerbun
*Assistant Examiner*—Michael A. Neas
*Attorney, Agent, or Firm*—Francis C. Hand

[57] ABSTRACT

The detaching roller aggregate comprises two pairs of cylinders each consisting of a detaching roller and a printing cylinder which are pressed against each other by means of a contact pressure device. The contact pressure device is arranged in such a way as to press the two cylinders of the second pair against each other with a larger force than the force pressing the two cylinders of the first pair together. The ratio of the two forces may be approximately 1.2:1 to 2:1. Due to the larger force with which the cylinders of the second pair are pressed against each other, a more even top fleece is produced, in particular during the combing of relatively long fibers and/or at high processing speeds.

15 Claims, 3 Drawing Sheets

DETACHING ROLLER AGGREGATE FOR A COMBING MACHINE

This invention relates to a detaching roller aggregate for a combing machine.

In presently available combing machines detaching roller aggregates are used which usually comprise two pairs of cylinders, each of which consists of a detaching roller rotatable in a pilgrim-step movement in the combing machine and a printing cylinder. In addition, a contact pressure device is usually provided for pressing the printing cylinder and the detaching roller against each other in each pair of cylinders. However, observations show that known detaching roller aggregates of this kind may cause irregularities in the top fleece, and particularly at high processing speeds and in the combing of relatively long-stapled fibers.

In the known detaching roller aggregates, the detaching roller and the printing cylinder in both pairs of cylinders are pressed against each other with the same force by the contact pressure device.

Accordingly, it is an object of the invention to prevent irregularities as much as possible in a top fleece both during combing of long stapled fibers as well as at high processing speeds.

It is another object of the invention to improve the operation of a combing machine by reducing irregularities in a top fleece produced by the machine.

Briefly, the invention is directed to a detaching roller aggregate for a combing machine comprised of a first pair of cylinders including a detaching roller and a printing cylinder wherein the detaching roller is rotatable in a pilgrim step movement as well as a second pair of cylinders including a second detaching roller and a second printing cylinder wherein the second detaching roller is rotatable in a pilgrim step movement. In accordance with the invention, means are provided for pressing the cylinders of the first pair of cylinders together under a first force and the cylinders of the second pair together under a second force which is larger than the first force.

In one embodiment, the detaching roller aggregate employs at least one yoke which carries a pair of bearings in each of which a respective printing cylinder is rotatably mounted. In this embodiment, the means for pressing the cylinders together includes a force generating element for imposing a force on the yoke at a position lying outside of a plane extending centrally between the two pairs of cylinders.

In another embodiment, the means for pressing the cylinders together employs a second force generating element for imposing a force on the yoke to bias the cylinders of each pair together. In this embodiment, at least one of the force generating elements may be in the form of a spring having an adjustable spring force.

In still another embodiment, instead of using a yoke, a pair of bearing carriers are provided with each carrier having a respective one of the printing cylinders rotatably mounted therein. In this embodiment, the means for pressing the cylinders together includes a pair of force generating elements, each of which is disposed to impose a force on a respective carrier in order to bias the cylinders of a respective pair of cylinders together. In this embodiment, each force generating element can be separately adjusted to impose a different force from the other element.

With such a detaching roller aggregate, it is actually possible to obtain a more even top fleece with smoother edges than with the known detaching roller aggregates, in particular during the combing of long-stapled fibers and/or at high processing speeds.

The reasons for this effect are not fully clear. A possible explanation is provided below with reference to an embodiment of the invention.

Preferably, the second force is at least 10% larger than the first force. The ratio between the magnitudes of the second and the first force may lie approximately between 1.2:1 and 2:1. In addition, it may also be preferable if the difference between the second force and the first force is adjustable.

These and other objects and advantages of the invention will become more apparent from the following detailed description taken in conjunction with the accompanying drawings wherein.

Figure 1:
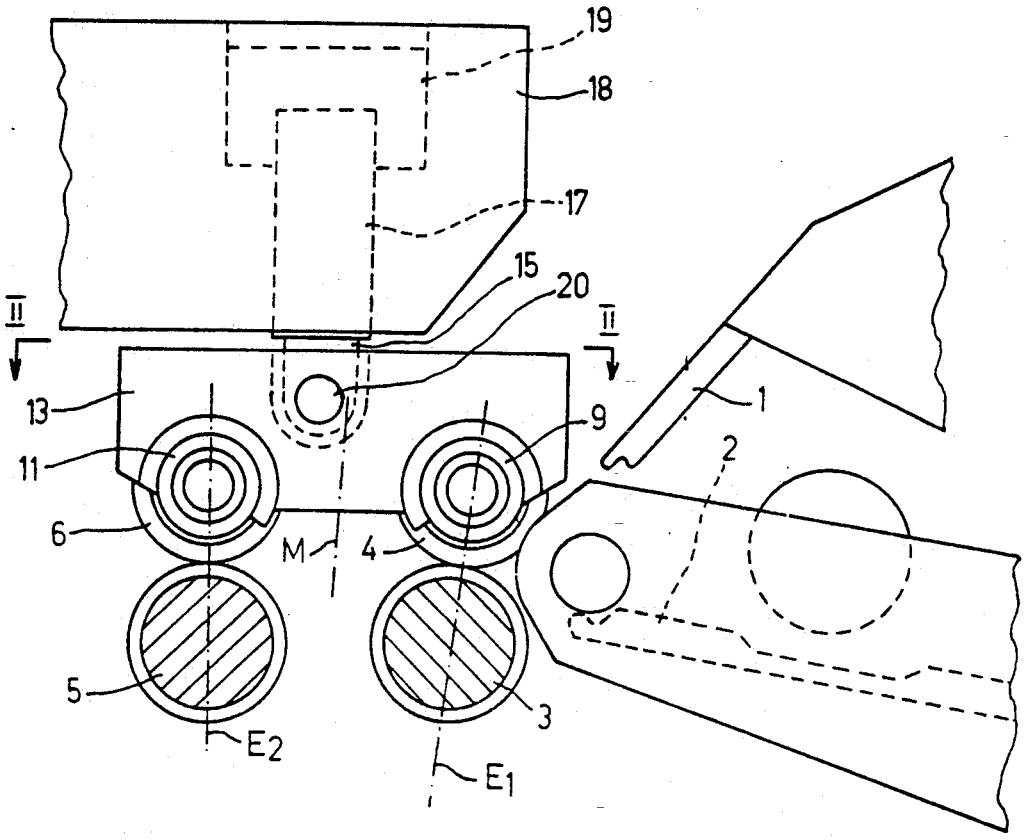
FIG. 1 illustrates a side view of a combing machine and detaching roller aggregate constructed in accordance with the invention.

Referring to FIG. 1, the combing machine employs a combing head of conventional structure having an oscillating nipper formed of a nipper knife plate 1 and a nipper plate 2. The nipper 1, 2 is represented in an advanced position near a detaching roller aggregate comprising two pairs of cylinders disposed parallel next to one another. The first pair of cylinders, which is nearer to nipper 1, 2, consists of a detaching roller 3 and a printing cylinder 4 and the second pair of cylinders, which is farther away from the nipper, consists of a detaching roller 5 and a printing cylinder 6.

During operation, a fiber tuft is clamped between the edges of the nipper plates 1, 2 in the retracted position of the nipper and is combed out by a rotating comb cylinder (not shown). The nipper 1, 2 is then moved forward to the advanced position and opened, whereafter the detaching rollers 3, 5 are rotated clockwise (as viewed) about a predetermined angle (in accordance with FIG. 1) by a drive (not shown) contained in the combing machine. As a result, the rear end of a previously formed top fleece emerges from the clamping position of the pair of cylinders 3, 4 and the front end of the fiber tuft lying on the nipper plate 2 comes to lie on this rear end of the fleece. Thereafter, the detaching rollers 3, 5 are rotated counter-clockwise about a second, larger predetermined angle so as to grasp and detach the fiber tuft from the nipper 1, 2.

The detaching roller aggregate also comprises a means in the form of a contact pressure device for pressing the detaching rollers 3 or 5 and the printing cylinder 4 or 6 against each other in each of the pairs of cylinders. In the embodiment represented in FIGS. 1 and 2, the ends of the detaching rollers 3, 5 are journalled in plates 7, 8 which are rigidly attached to the frame (FIG.

2), whereas the ends of the printing cylinders 4, 6 are rotatably supported in bearings 9, 10 and 11, 12 mounted in a pair of yokes 13, 14.

The contact pressure device includes a force generating means coupled to each yoke 13, 14 in the form of a piston tappet 15 or 16, respectively. FIG. 1 shows only the piston tappet 15. Each piston tappet 15, 16 has a respective piston 17 which is displaceably held in a block 18 rigidly attached to the frame during operation. The block 18 houses a chamber 19 above the upper end of the piston 17 to which compressed air is supplied via a conduit (not shown) during operation so as to push down the piston 17 and, thus, the yoke 13, which presses the printing cylinders 4, 6 against the respective detaching rollers 3, 5.

The printing cylinder 6 and the detaching roller 5 of the second pair of cylinders are pressed against each other with a larger force than the printing cylinder and the detaching roller 3 of the first pair. For this purpose, a coupling position 20 of the piston tappet 15 on the yoke 13 lies, according to FIG. 1, outside of a plane M located centrally between the two pairs of cylinders 3, 4 and 5, 6. The central plane M is the angle bisecting plane between a plane $E_1$ extending through the axes of the cylinders 3, 4 and a plane $E_2$ extending through the axes of the cylinders 4, 6. The ratio between the two forces is preferably approximately 1.2:1 to approximately 2:1.

Because the force With which the printing cylinder 6 is pressed against the detaching roller 5 is larger than the contact pressure force exerted on the printing cylinder 4, a more even top fleece with smoother edges is obtained, in particular at relatively high processing speeds. The reasons for this is not fully clear yet. A possible explanation is provided below.

At the beginning of the detaching process, the detaching rollers 3, 5 are accelerated as described above (in a counter-clockwise direction according to FIG. 1). The detaching rollers 3, 5 then accelerate the printing cylinders 4, 6 by exerting forces on these in the nip lines of the pairs of cylinders extending in the direction of the first pair of cylinders 3, 4 to the second pair of cylinders 5, 6. These forces may exert torques onto the bearings 9, 10, 11, 12 of the elements (yokes 13, 14) holding the printing cylinders 4, 6. These torques lead to an additional load of the first printing cylinder 4 and to a load relief of the second printing cylinder 6. Despite such relief, the second printing cylinder 6 is still pressed with a sufficient force against the second detaching roller 5, because the static force exerted by the contact pressure device onto the second printing cylinder 6 is larger than the static force exerted on the first printing cylinder 4.

In preferred embodiments of the detaching roller aggregate, it is also possible to allow the ratio between the two forces to be adjustable. Variations with adjustable ratios of forces are schematically shown in FIGS. 3, 4 and 5, whereby the cylinders 3, 4, 5 and 6 are not represented in these Figs.

Figure 3:
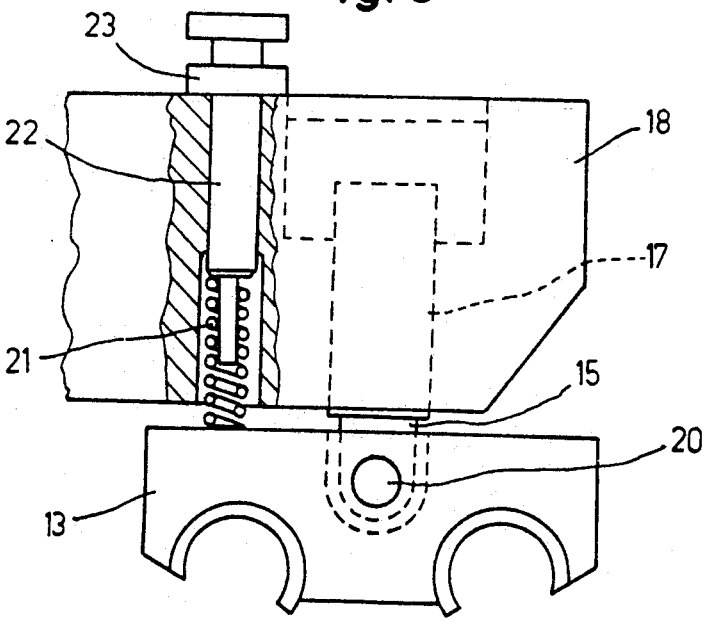
FIG. 3 illustrates a partial cross-sectional side view of a modified detaching roller aggregate in accordance with the invention employing a second force generating element.
Figure 2:
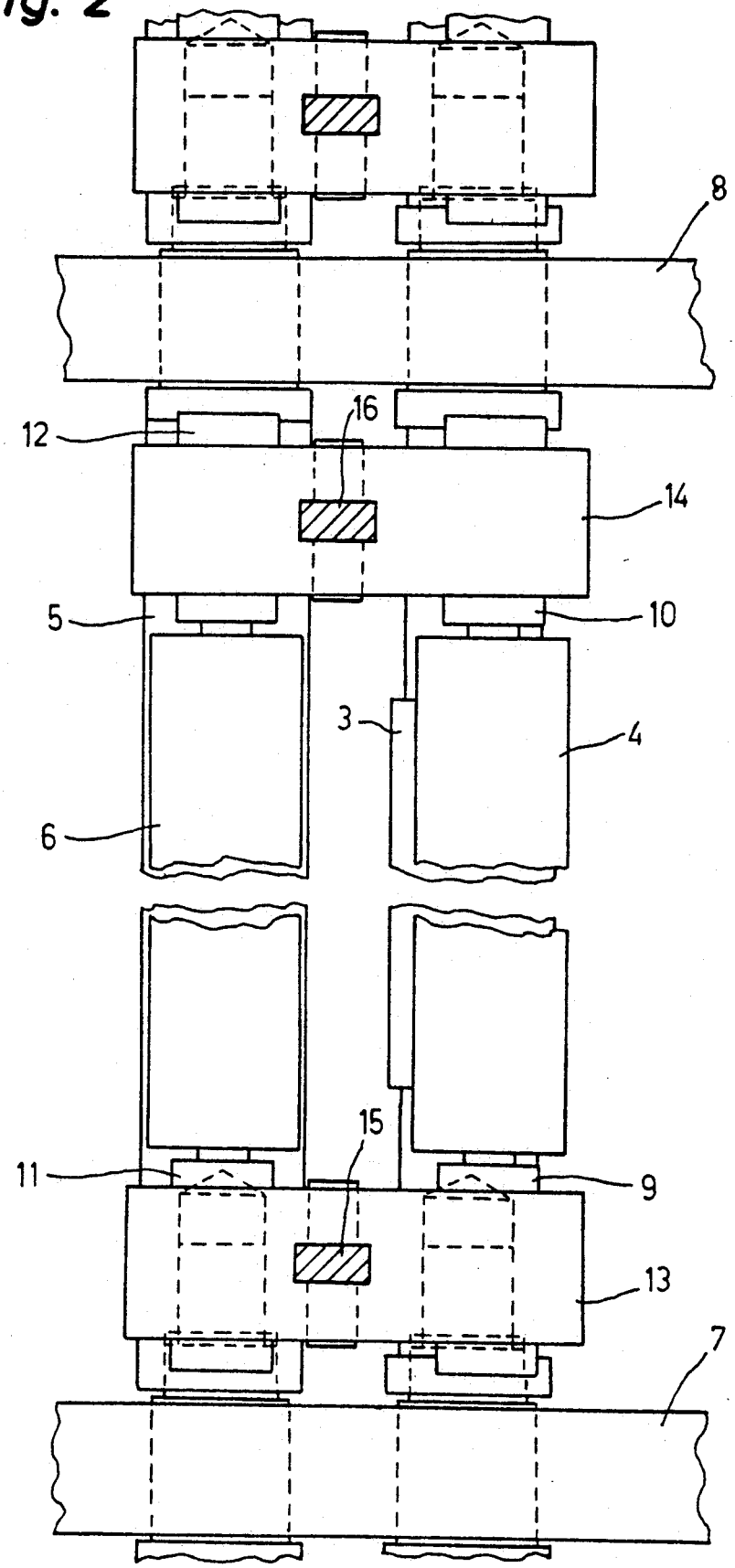
FIG. 2 illustrates a view taken on line II—II of FIG. 1.

Referring to FIG. 3, wherein like reference characters indicate like parts as above, in addition to the piston tappet 15, a second force generating means in form of a pressure spring 21 is coupled with the yoke 13. The other end of the spring 21 abuts an adjusting screw 22 which is screwed into a threaded bore in the block 18 and secured by a lock nut 23. By readjusting the adjusting screw 22, it is possible to change the force with which the spring 21 presses onto the yoke 13. This pressing occurs outside of the central plane M between the two pairs of cylinders and nearer to the second pair of cylinders 5, 6 (FIGS. 1, 2). The coupling position 20 of the piston tappet 15 may lie in this central plane or also Outside thereof.

It is also possible to leave out the adjusting screw 22 with the lock nut 23 and to simply provide the pressure spring 21 in a blind-end bore in the block 18 and/or in the yoke 13. To change the pressure force, it is possible to simply exchange the spring 21.

Figure 4:
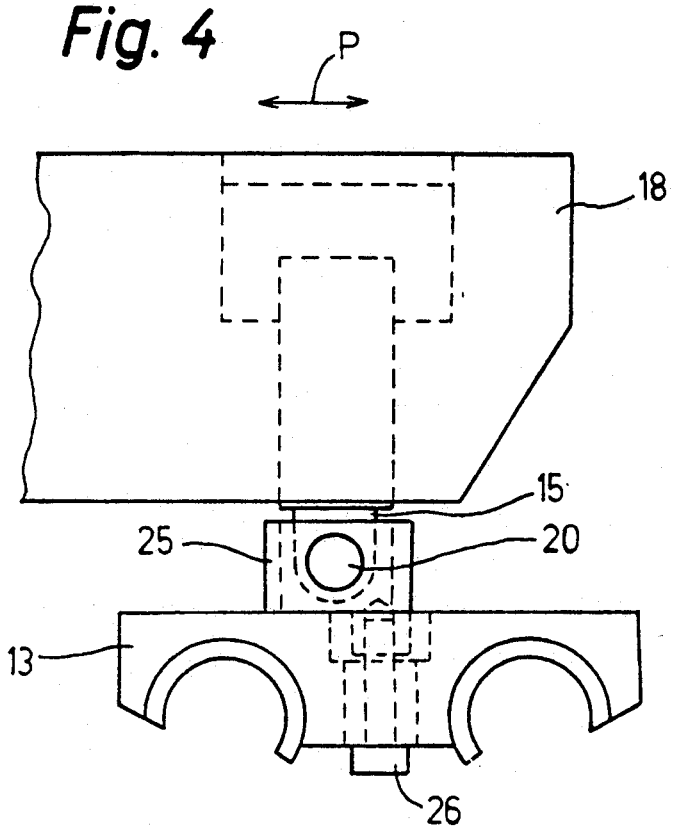
FIG. 4 illustrates a view similar to FIG. 3 of a further modified detaching roller aggregate in accordance with the invention.
Figure 5:
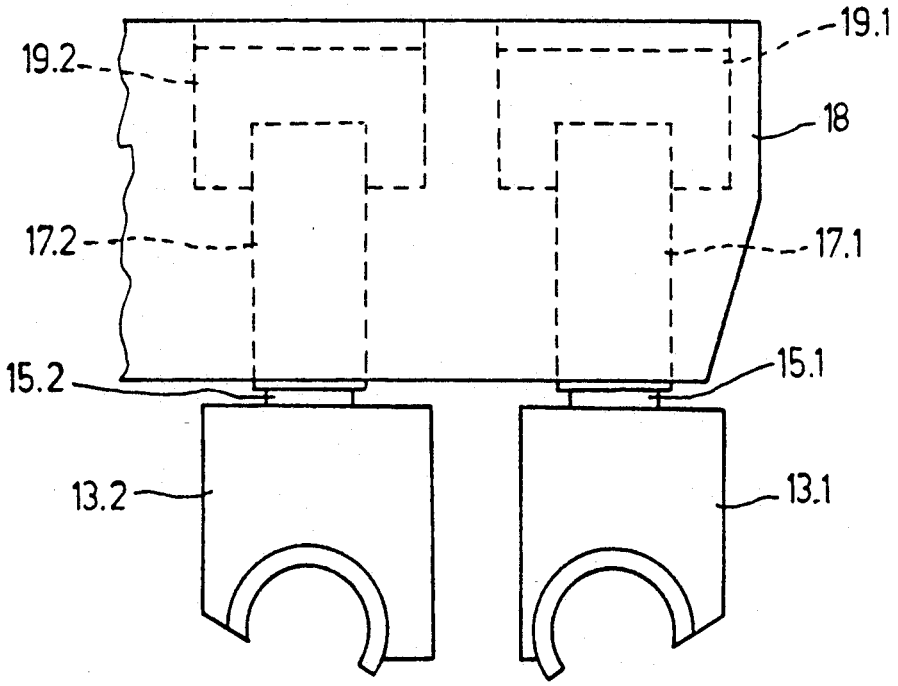
FIG. 5 illustrates a view similar to FIGS. 3 and 4 of a further modified detaching roller aggregate employing a pair of bearing carriers in accordance with the invention.

Referring to FIG. 4, wherein like reference characters indicate like parts as above, the whole block 18 may be displaceable in the direction of the double arrow P and may be fixable in any set position by suitable means (not shown). A sliding contact 25 is coupled with the piston tappet 15, which contact is held displaceable with respect to the yoke 13 and which can be fixed by means of a screw 26. Depending on the set position of the block 18 and sliding contact 25, the coupling position 20 of the piston tappet 15 lies outside of the central plane between the two pairs of cylinders by either a larger or a smaller amount.

Referring to FIG. 5, wherein like reference characters indicate like parts as above, instead of a yoke 13, use is made of two separate bearing carriers 13.1 and 13.2 for the bearings 9 and 11 (FIGS. 1, 2) of the two printing cylinders 4 and 6. The block 18 comprises, for each of the bearing carriers 13.1 and 13.2, a piston 17.1, 17.2 to whose piston tappets 15.1, 15.2 are attached the respective bearing carriers. By changing the pressures supplied to the pistons 17.1, 17.2 via chambers 19.1, 19.2, it is possible to individually set the pressures with which the bearing carriers 13.1, 13.2 are pressed downwardly. Naturally, it is also possible to provide one piston 17.2 with a larger diameter than the other piston 17.1 and then supply the chamber 19.1, 19.2 with the same pressure.

Further embodiments are possible. In particular, the pistons 17, 17.1, 17.2 could, if desired, be replaced by pressure springs, whereby the pressure force exerted by the springs could also be adjustable. On the other hand, in the embodiment in accordance with FIG. 3, the pressure spring 21 coupled with the left end of yoke 13 could be replaced by a second piston fed with a pressure medium and coupled with the left end of the yoke 13.

The invention thus provides a detaching roller aggregate for a combing machine which is able to reduce, if not eliminate, irregularities in a top fleece being processed by the combing machine. In particular, the invention provides a detaching roller aggregate which is able to reduce irregularities in a top fleece both during the combing of long-stapled fibers as well as during combing of fibers at high processing speeds.

What is claimed:

1. A detaching roller aggregate for a combing machine comprising a first pair of cylinders including a detaching roller and a printing cylinder for receiving a fiber tuft from a combing machine for attachment to a previously formed fleece, said detaching roller being rotatable in a pilgrim step movement;

a second pair of cylinders including a second detaching roller and a second printing cylinder for passage of the fleece therebetween, said second detaching roller being rotatable in a pilgrim step movement; and means for pressing said cylinders of said first pair together under a first force against each other and said cylinders of said second pair together under a second force against each other larger than said first force.

2. A detaching roller aggregate as set forth in claim 1 wherein said second force is at least 10% larger than said first force.

3. A detaching roller aggregate as set forth in claim 1 wherein the ratio between said second force and said first force is from 1.2:1 to 2:1.

4. A detaching roller aggregate as set forth in claim 3 wherein said ratio is adjustable.

5. A detaching roller aggregate as set froth in claim 1 which further comprises at least one yoke; and a pair of bearings in said yoke, each bearing having a respective one of said printing cylinders rotatably mounted therein; and wherein said means for pressing said cylinders includes a force generating element for imposing a force on said yoke at a position lying outside of a plane extending centrally between said pairs of cylinder.

6. A detaching roller aggregate as set forth in claim 5 wherein said force generating element is adjustably mounted relative to said yoke to shift said position transversely of said plane.

7. A detaching roller aggregate as set forth in claim 6 wherein said force generating element is coupled to said yoke.

8. A detaching roller aggregate as set forth in claim 5 wherein said means for pressing said cylinders includes a second force generating element for imposing a force on said yoke to bias said cylinders of each said pair together.

9. A detaching roller aggregate as set forth in claim 8 wherein at least one of said force generating elements is a spring having an adjustable spring force.

10. A detaching roller aggregate as set forth in claim 1 which further comprises a pair of bearing carriers, each carrier having a respective one of said printing cylinders rotatably mounted therein and wherein said means includes a pair of force generating elements, each element being disposed to impose a force on said respective carrier to bias said cylinders of a respective pair together.

11. In combination, a combing head having an oscillating nipper; and a detaching roller aggregate adjacent said nipper to detach fiber tufts therefrom, said aggregate having two pairs of parallel cylinders for receiving fiber therebetween and means for pressing said cylinders of an upstream pair of said paris together under a first force and said cylinders of a downstream pair of said pairs together under a second force larger than said first force.

12. The combination as set forth in claim 11 wherein said second force is at least 10% larger than said first force.

13. The combination as set forth in claim 11 wherein the ratio between said second force and said first force is from 1.2:1 to 2:1.

14. The combination as set forth in claim 11 which further comprises at least one yoke and a pair of bearings in said yoke, each bearing having one cylinder of a respective pair of cylinders rotatably mounted therein and wherein said means for pressing said cylinders includes a force generating element for imposing a force on said yoke at a position lying outside of a plane extending centrally between said pairs of cylinders.

15. The combination as set forth in claim 14 wherein said force generating element is adjustably mounted relative to said yoke to shift said position transversely of said plane.

* * * * *